US011905860B2

(12) United States Patent
Brown et al.

(10) Patent No.: US 11,905,860 B2
(45) Date of Patent: Feb. 20, 2024

(54) LATCH ASSEMBLY, LATCHING DEVICE, AND ROCKER ARM

(71) Applicant: Eaton Intelligent Power Limited, Dublin (IE)

(72) Inventors: Jeffrey R. Brown, Marshall, MI (US); Matthew A. Vance, Kalamazoo, MI (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/778,514

(22) PCT Filed: Nov. 20, 2020

(86) PCT No.: PCT/EP2020/025530

§ 371 (c)(1),
(2) Date: May 20, 2022

(87) PCT Pub. No.: WO2021/098988

PCT Pub. Date: May 27, 2021

(65) Prior Publication Data

US 2022/0412232 A1 Dec. 29, 2022

Related U.S. Application Data

(60) Provisional application No. 62/937,855, filed on Nov. 20, 2019.

(51) Int. Cl.

| | |
|---|---|
| ***F01L 1/18*** | (2006.01) |
| ***F01L 1/24*** | (2006.01) |
| ***F01L 1/34*** | (2006.01) |

(52) U.S. Cl.

CPC ..... *F01L 1/185* (2013.01); *F01L 1/2416* (2013.01); *F01L 1/34* (2013.01)

(58) Field of Classification Search

CPC . F01L 1/34; F01L 1/185; F01L 1/2416; F01L 13/0005; F01L 2001/186;

(Continued)

(56) References Cited

U.S. PATENT DOCUMENTS

| | | | |
|---|---|---|---|
| 2007/0039573 | A1 | 2/2007 | Deierlein |
| 2011/0226208 | A1 | 9/2011 | Zurface et al. |

(Continued)

FOREIGN PATENT DOCUMENTS

| | | | |
|---|---|---|---|
| CN | 102892977 | A | 1/2013 |
| CN | 104791034 | A | 7/2015 |

(Continued)

OTHER PUBLICATIONS

International Search Report and Written Opinion for PCT/EP2020/025530; dated May 4, 2021; pp. 1-9.

*Primary Examiner* — Kenneth J Hansen
*Assistant Examiner* — Kelsey L Stanek
(74) *Attorney, Agent, or Firm* — Pearne & Gordon LLP

(57) ABSTRACT

A latch assembly comprises a latch pin and a cage. The latch pin comprises a latch nose and a pin body. The pin body comprises an outer surface and an inner compartment. The inner compartment comprises a first inner wall segmented by a first slot and a second inner wall segmented by a second slot. The first slot and the second slot vent out of the inner compartment. The cage comprises a stepped base and a shaft extending from the stepped base into the inner compartment. The shaft comprises a first exterior flat adjoining the first inner wall and a second exterior flat adjoining the second inner wall. A spring can be biased against the latch pin and the cage. The latch assembly can be used in a latching device of a valvetrain such as a switching roller finger follower or other rocker arm.

15 Claims, 6 Drawing Sheets

(58) Field of Classification Search
CPC ..... F01L 2013/001; F01L 2013/105; F01L 2303/00; F01L 2305/00; F01L 2810/02
USPC ..... 123/90.39
See application file for complete search history.

(56) References Cited

U.S. PATENT DOCUMENTS

| | | | | |
|---|---|---|---|---|
| 2014/0290608 | A1* | 10/2014 | Radulescu | F01L 1/46 123/90.39 |
| 2016/0169064 | A1* | 6/2016 | Radulescu | F01L 1/18 123/90.16 |
| 2016/0215658 | A1 | 7/2016 | Hoskins | |
| 2017/0051643 | A1 | 2/2017 | Radulescu | |
| 2018/0094551 | A1 | 4/2018 | Mohan et al. | |
| 2018/0363519 | A1 | 12/2018 | Radulescu et al. | |
| 2019/0309659 | A1 | 10/2019 | Vance | |

FOREIGN PATENT DOCUMENTS

| | | | |
|---|---|---|---|
| CN | 109923286 | A | 6/2019 |
| WO | 2013067506 | A1 | 5/2013 |
| WO | 2015031887 | A1 | 3/2015 |
| WO | 2016028812 | A1 | 2/2016 |
| WO | 2016187087 | A1 | 11/2016 |
| WO | 2017091798 | A1 | 6/2017 |

* cited by examiner

LATCH ASSEMBLY, LATCHING DEVICE, AND ROCKER ARM

This is a United States § 371 National Stage Application of PCT/EP2020/025530 filed Nov. 20, 2020 and claims the benefit of U.S. provisional application 62/937,855 filed Nov. 20, 2019, all of which are incorporated herein by reference.

FIELD

This application provides a latch assembly that can be installed in a latching device of a valvetrain, such as a rocker arm.

BACKGROUND

Valvetrains can comprise switchable components for enabling variable valve actuation (VVA) such as lost motion, added motion, among others. One such valvetrain component is a rocker arm. Rocker arms such as switching roller finger followers (SRFFs) can comprise a device for locking and unlocking relative motion of the components of the rocker arm. The response time of the device confines the implementation of the VVA. If the device cannot lock and unlock quickly enough, the functionality of the rocker arm cannot be used as engine speeds increase above the response time of the device. So, it is desired to have fast actuation for locking and unlocking the valvetrain components.

SUMMARY

The methods and devices disclosed herein overcome the above disadvantages and improves the art by way of a ventilated latch assembly for a hydraulically actuated switching rocker arm.

A latch assembly comprises a latch pin and a cage biased by a spring. The latch pin comprises a latch nose and a pin body connected to the latch nose. The pin body comprises an outer surface and an inner compartment. The inner compartment comprises a first inner wall segmented by a first slot and a second inner wall segmented by a second slot. The first slot and the second slot vent out of the inner compartment. The cage comprises a stepped base and a shaft extending from the stepped base into the inner compartment. The shaft comprises a first exterior flat adjoining the first inner wall and a second exterior flat adjoining the second inner wall. A spring can be biased against the latch pin and the cage. The latch assembly can be used in a latching device of a valvetrain such as a switching roller finger follower or other rocker arm.

The shaft can further comprise a first exterior arc surface and a second exterior arc surface. The inner compartment can comprise an inner circumference segmented into a first arc, a first chord, a second arc, and a second chord. The first chord is part of the first inner wall, and the second chord is part of the second inner wall. The first arc surface can be opposite to the second arc surface about a long axis of the latch pin. The first exterior arc surface can adjoin the first arc surface and the second exterior arc surface can adjoin the second arc surface.

The stepped base can form a travel limit for the pin body. Alternatively, the shaft can form a travel limit for the pin body. Additionally, the stepped base can be solid. And, the shaft can comprise a hollow portion. A solid spring cup can be between the stepped base and the hollow portion.

A latching device can comprise the latch assembly. The latching device can comprise a housing comprising a latch bore comprising a main inner circumference. The latch pin can be configured to slide in the latch bore with the outer surface adjacent the main inner circumference. The stepped base can be fitted to a portion of the main inner circumference.

The stepped base can comprise a first end flat parallel to the first flat and a second end flat parallel to the second flat. The stepped base can span across the main inner circumference to fit to opposed sides of the main inner circumference. The first end flat and the second end flat can be spaced away from the main inner circumference.

The housing can further comprise an outer end surface through which the latch bore passes. The stepped base can comprise a first step and a second step positioned against the outer end surface.

The latching device can further comprising an oil feed through the housing and connected to the latch bore. The latching device is configured so that oil fed via the oil feed can vent out of the latch bore and out of the spaces between the first end flat and the second end flat that can be spaced away from the main inner circumference A rocker arm can comprise the latching device and latch assembly. The rocker arm can comprise a pair of outer arms integrated with the housing. An inner arm can be coupled to the pair of outer arms. The inner arm can be configured to selectively move relative to the latch pin when the latch pin is retracted into the latch bore and the inner arm can be configured to selectively abut the latch nose when the latch pin protrudes from the latch bore.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1:
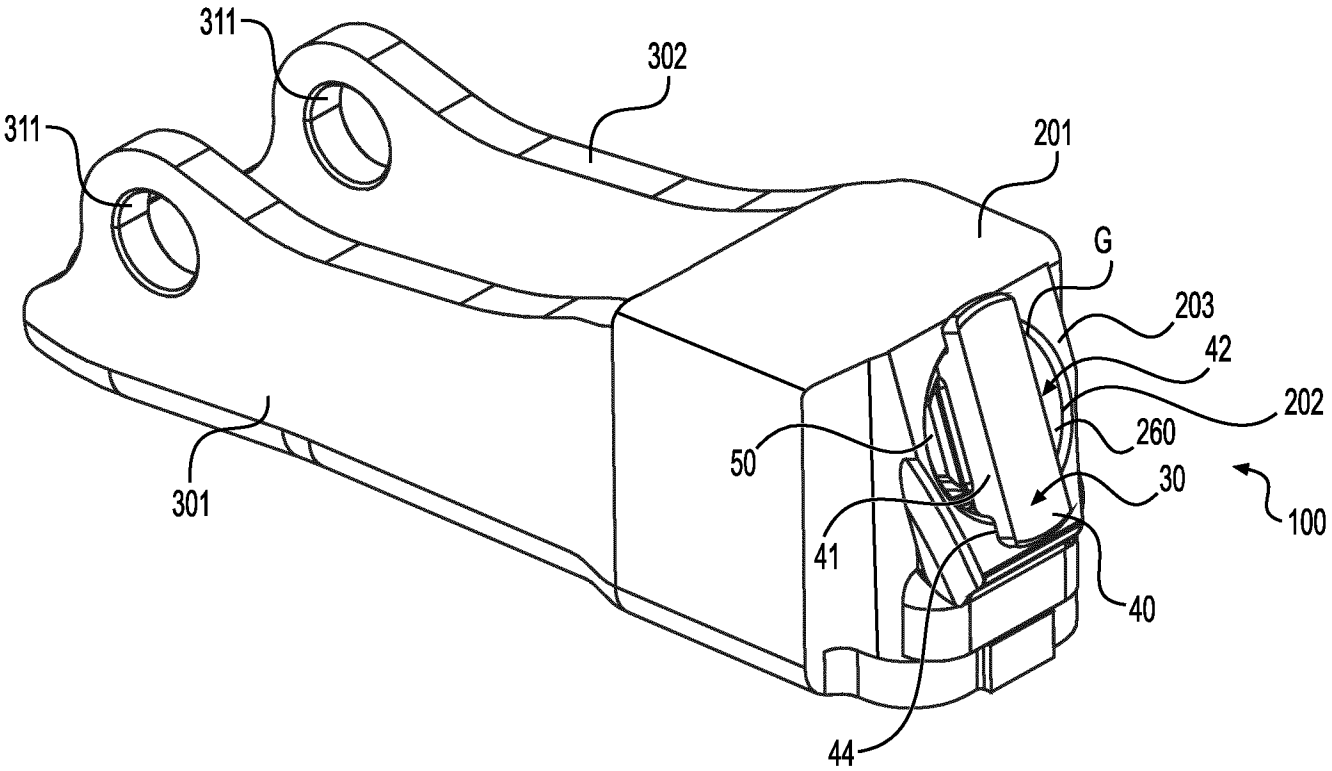
FIG. 1 is a view of a latch assembly in a latching device.
Figure 2:
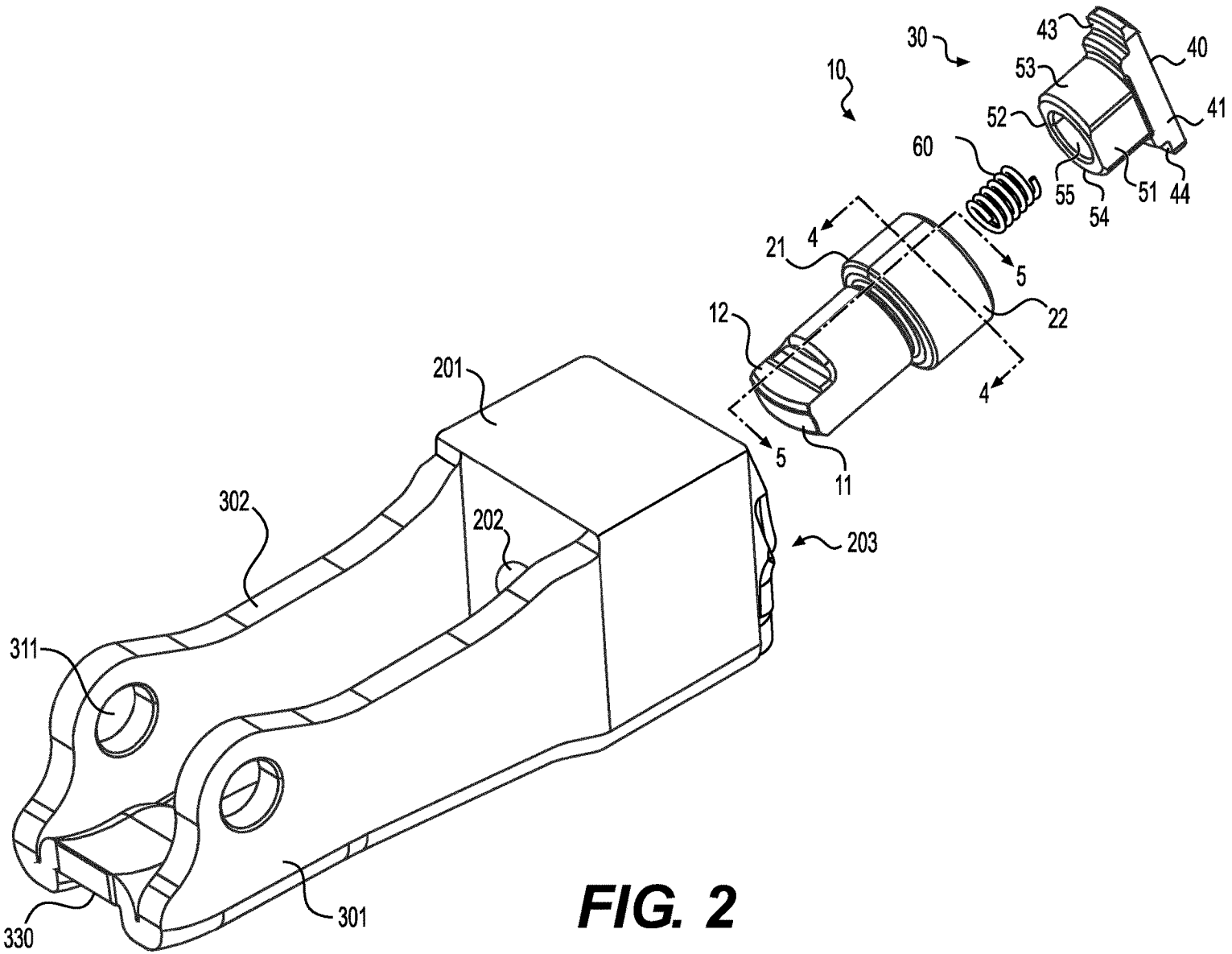
FIG. 2 is an exploded view of latch assembly and latching device.

Reference will now be made in detail to the examples which are illustrated in the accompanying drawings. Wherever possible, the same reference numbers will be used throughout the drawings to refer to the same or like parts.

The disclosure provides a system and device for increased ventilation for a latching mechanism. A latch assembly 100 can constitute a ventilated latching mechanism for a hydraulically-actuated switching rocker arm 300 or other variable valvetrain component. The latch assembly 100 is designed to allow for improved response time of the latch pin 10. A non-round latch cage 30 increases the flow area 260 which is exposed to atmospheric pressure, thus improving switching performance.

Figure 3A:
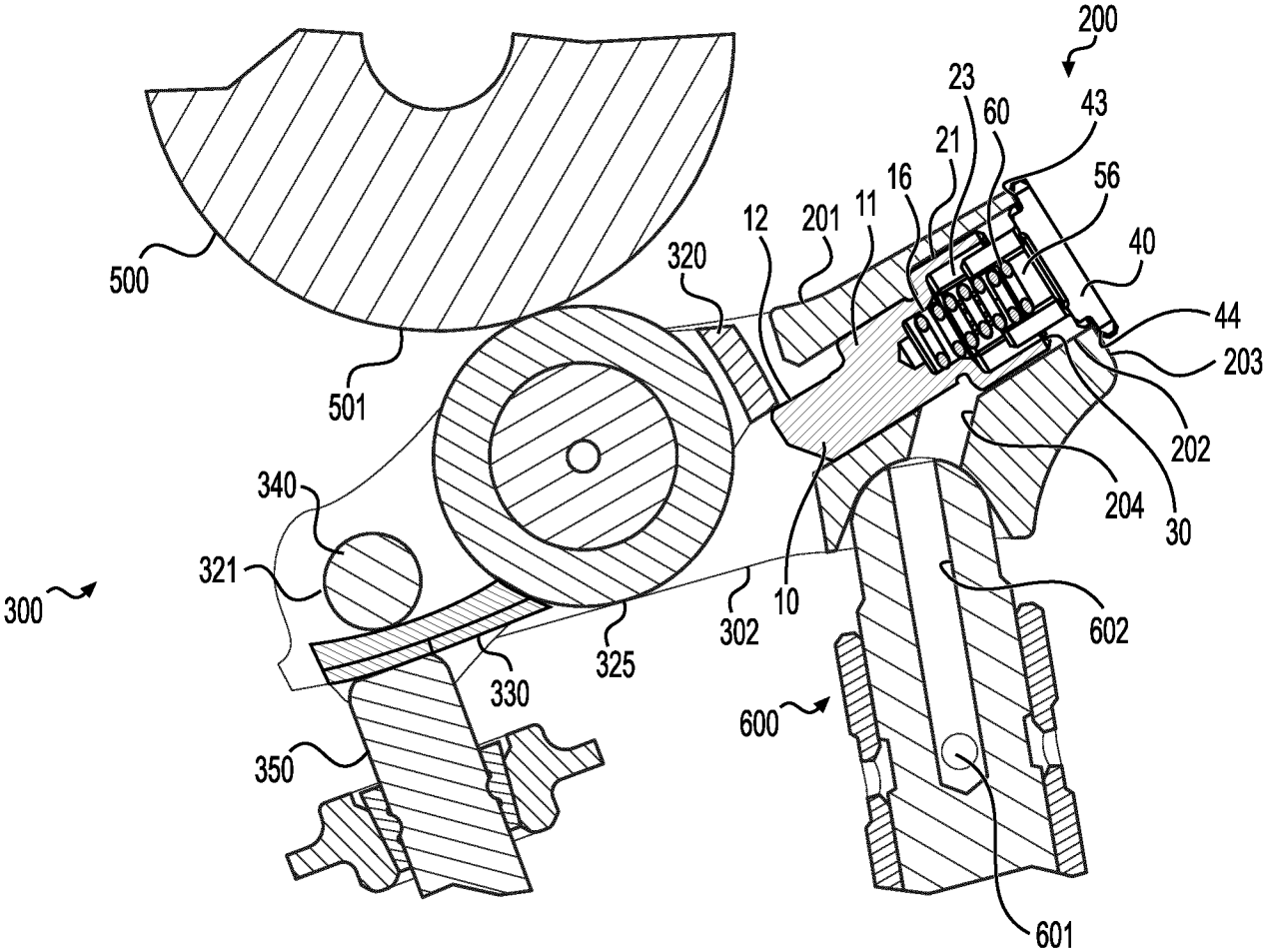
FIGS. 3A & 3B are cross-section views of a rocker arm relative to the latch assembly and latching device.
Figure 3B:
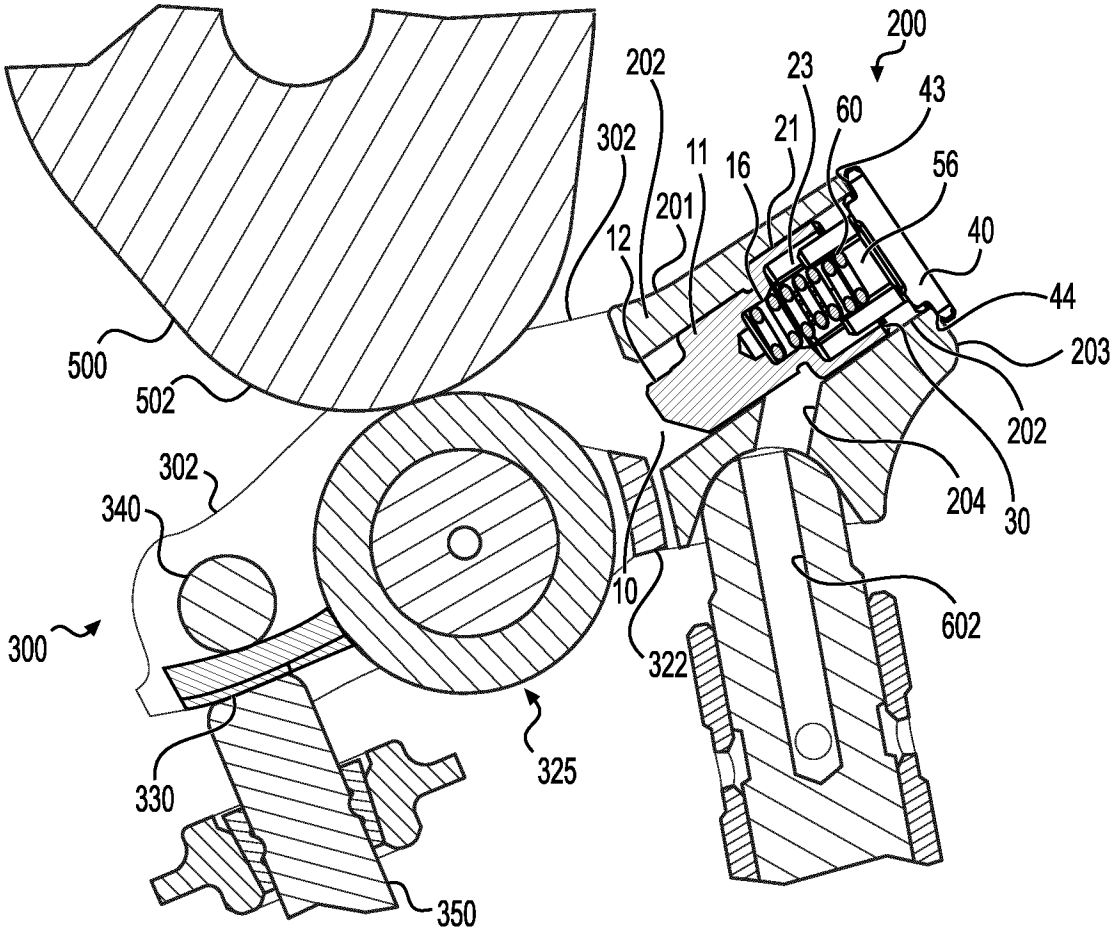
Figure 4:
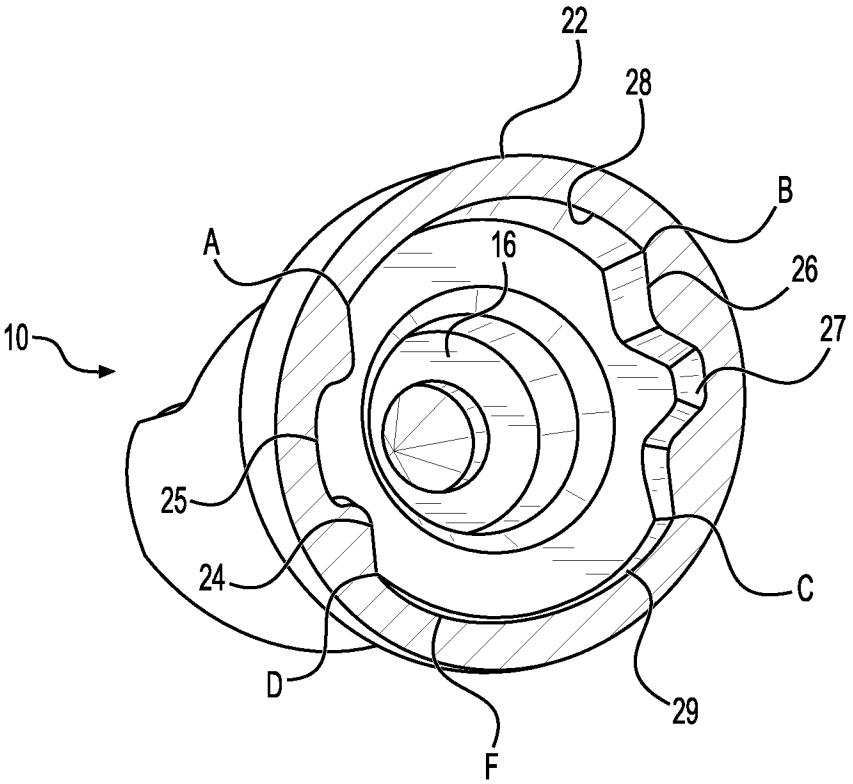
FIGS. 4 & 5 are cross-section views of the latch pin.
Figure 5:
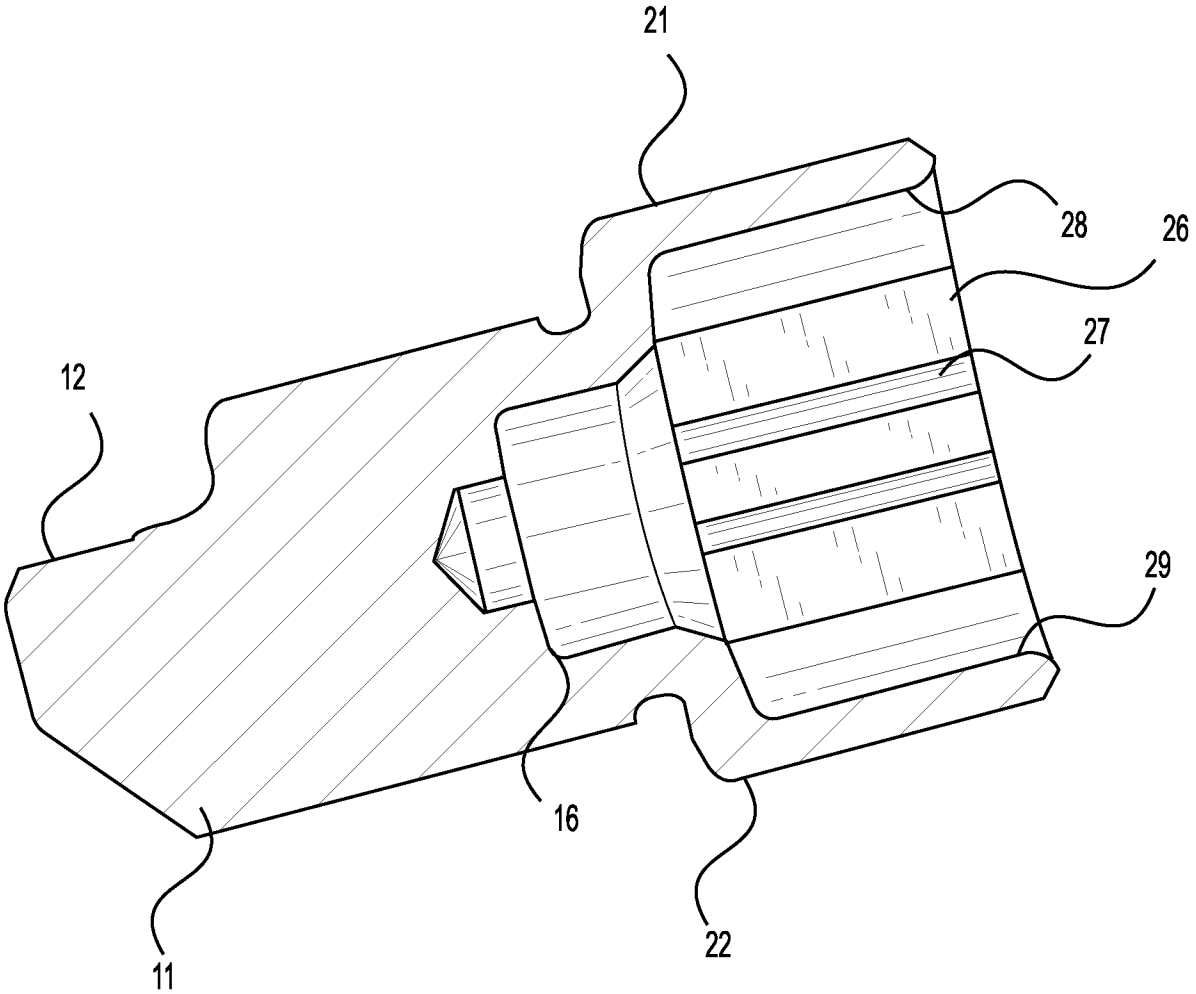

An optimized latch pin 10 response time can be achieved for switching rocker arm 300 engine applications which have low available pressure. A rocker arm 300 can be configured to switch between a latched condition, shown in FIG. 3A, and an unlatched condition, shown in FIG. 3B. In the latched condition, the inner arm 320 is held in place relative to a pair of outer arms 301, 302. An overhead cam 500 can press a roller assembly 325 which in turn transfers a lift profile to a valve. When the cam 500 positions base circle 501 at the roller assembly 325 is the usual location where latch assembly 100 can be actuated to withdraw latch pin 10 into latch bore 202. FIG. 3B shows this unlatched condition where the latch pin 10 is withdrawn into latch bore 202. A valve lift profile 502 is lost when the inner arm 320 pivots around pivot axle 340 in pivot bores 321, 311. Latch seat 322 swings past the latch nose 11 and no actuation force is transferred to the valve stem 350.

A latch assembly 100 comprises a latch pin 10 and a cage 30 biased by a spring 60. Spring 60 can be seated in a spring seat 16 of the latch pin 10. Spring seat 16 can comprise a cup, rim, stake or the like.

The latch pin 10 comprises a latch nose 11. A latch step 12 can be included on the latch nose 11. Latch step 12 and latch nose 11 can comprise a crown, flat, chamfer, among other features for catching against or furthering sliding of the inner arm 320 and latch seat 322.

Pin body 21 is connected to the latch nose 11. The pin body 21 comprises an outer surface 22 and an inner compartment 23. The inner compartment 23 comprises a first inner wall 24 segmented by a first slot 25 and a second inner wall 26 segmented by a second slot 27. The first slot 25 and the second slot 27 vent out of the inner compartment 23. Actuation fluid can traverse the first and second slot 25, 27 while the first inner wall 24 and second inner wall 26 can form a keyed structure with the cage 30. The keyed structure can prevent rotation of the latch pin 10 in the latch bore 202, which improves the seating of the latch seat 322 against the step 12 of latch nose 11. The size of the first and second slot 25, 27 can be sized for the response time of the latch assembly 100. The first and second slot 25, 27 can function like controlled orifices so that when the spring 60 pushes the latch pin 10 to protrude out of the latch bore 202 to return to the latched condition, the actuation fluid that is venting out of the latching device 200 can be suctioned through the first and second slots 25, 27. This suction can be controlled to tailor the resistance to the motion of the latch pin 10 and can be used to control the speed of the response time. Having little resistance at flow area 260, it is easy for the venting actuation fluid to be suctioned to fill the space in the latch bore 202 as the latch pin 10 moves from the unlatched condition to the latched condition.

The cage 30 comprises a stepped base 40 and a shaft 50 extending from the stepped base 40 into the inner compartment 23. The shaft 50 can have a complementary keyed structure with the inner compartment 23. The shaft 50 can comprise a first exterior flat 51 adjoining the first inner wall 24 and a second exterior flat 52 adjoining the second inner wall 26. A spring 60 can be biased against the latch pin 10 and the cage 30. The latch assembly 100 can be used in a latching device 200 of a valvetrain such as a switching roller finger follower or other rocker arm 300.

The shaft 50 can further comprise a first exterior arc surface 53 and a second exterior arc surface 54. The inner compartment 23 can comprise an inner circumference F segmented into a first arc AB, a first chord BC, a second arc CD, and a second chord DA. The first chord BC is part of the second inner wall 26, and the second chord DA is part of the first inner wall 24. The first arc AB can be part of a first arc surface 28. The second arc CD can be part of a second arc surface 29. The first arc AB can be opposite to the second arc CD relative to a center point of the circumference F. The first arc surface 28 can be opposite to the second arc surface 29 about a long axis of the latch pin 10. The first exterior arc surface 53 can adjoin the first arc surface 28 and the second exterior arc surface 54 can adjoin the second arc surface 29.

The stepped base 40 can form a travel limit for the pin body 21. The latch pin 10 could be configured so that it travels into the latch bore 202 until it abuts the stepped base 40. Alternatively, the shaft 50 can form a travel limit for the pin body 21. The latch pin 10 could be configured so that it travels into the latch bore 202 until it abuts the end of shaft 50. Additionally, the stepped base 40 can be solid. By solid, the stepped base 40 can have no hole for oil to flow through. This is a departure from prior art cages where the base of the cage forms a controlled orifice for releasing actuation fluid out of the latch bore. Instead, the shaft 50 can comprise a hollow portion 55. Yet actuation fluid cannot vent out the solid stepped base 40 through the hollow portion 55. A solid spring cup 56 can be formed by adding or including material inside the shaft 50 between the stepped base 40 and the hollow portion 55. The spring cup 56, being solid, does not permit actuation fluid to pass through the inside of the shaft 50. The inside of the shaft instead guides the spring 60 and forms a pocket 35 with the inner compartment 23 for cushioning against the actuation fluid. Actuation fluid that is trapped in the pocket 35 can pressurize against the solid spring cup 56 or solid stepped base 40. In order to vent from the pocket 35, the actuation fluid must travel in the space between the adjoining inner compartment 23 and shaft 50, including travel in the first and second slots 25, 27. The keyed structure between the cage 30 and latch pin 10 can thus also be controlled to tailor the response time of the latch assembly 100, with fluid trapped in the pocket 35 forming a controllable resistance to actuation fluid acting on outer surface 22. A smooth, controlled actuation can be achieved by balancing the actuation pressure from oil feed 204 to latch bore 202, the leaking of trapped actuation fluid from pocket 35, and the venting out of flow area 260.

A latching device 200 can comprise the latch assembly 100. The latching device 200 can comprise a housing 201 through which a latch bore 202 passes. Latch bore 202 can be a through-hole in the housing 201. Latch bore 202 can be stepped to follow some exterior profiles on the latch pin 10 so as to guide the latch pin 10 and prevent rotation of the latch pin 10 relative to the device to be latched, such as rocker arm 300. Latch bore 202 can comprise a main inner circumference G. The latch pin 10 can be configured to slide in the latch bore 202 with the outer surface 22 adjacent the main inner circumference G. The stepped base 40 can be fitted to a portion of the main inner circumference G.

The stepped base 40 can comprise a first end flat 41 parallel to the first exterior flat 51 and a second end flat 42 parallel to the second exterior flat 52. The stepped base 40 can span across the main inner circumference G to fit to opposed sides of the main inner circumference G. The first end flat 41 and the second end flat 42 can be spaced away from the main inner circumference G.

The housing 201 can further comprise an outer end surface 203 through which the latch bore 202 passes. The stepped base 40 can comprise a first step 43 and a second step 44 positioned against the outer end surface 203. The stepped base 40 can be press-fit to or otherwise grip the latch bore 202 via the first and second steps 43, 44.

The latching device 200 can further comprising an oil feed 204 through the housing 201. The oil feed 204 can be connected to the latch bore 202 so that pressurized actuation fluid acts on the outer surface 22 of the latch pin 10 to move the latch pin 10. The oil feed 204 can be fed, for example, via a feed port 601 and flow path 602 of a hydraulic lash adjuster (HLA) 600. The latching device 200 is configured so that oil fed via the oil feed 204 can vent out of the latch bore 202 and out of the flow areas 260 formed by spaces between the first end flat 41 and the second end flat 42. The first and second end flats 41, 42 can be spaced away from the main inner circumference G thereby forming the flow areas 260. The large area and exposure to atmospheric pressure allows for fast venting of the actuation fluid. And, the design of the adjoining shaft 50 and inner compartment 23 can control the pressure needed to actuate the latch assembly 100. How quickly the actuation fluid can build pressure and subsequently vent out controls the response time of the latch assembly 100 and latching device 200. The design of the stepped base, with the first and second end flats 41, 42 permits a high surface area exposure to atmospheric pressure for flow areas 260.

A rocker arm 300 can comprise the latching device 200 and latch assembly 100. The rocker arm 300 can comprise a pair of outer arms 301 integrated with the housing 201. An inner arm 320 can be coupled to the pair of outer arms 301. The inner arm 320 can be configured to selectively move relative to the latch pin 10 when the latch pin 10 is retracted into the latch bore 202 and the inner arm 320 can be configured to selectively abut the latch nose 11 when the latch pin 10 protrudes from the latch bore 202. The rocker arm 300 can comprise numerous alternatives for the inner and outer arm configurations, including rollers, slider pads, cantilevered posts, among others. The pivot location of the inner and outer arms, or valve seating configuration, or location of the latch assembly over the valve side or over the pivot side, can be varied, with the latch assembly 100 being movable and usable in place of other rocker arm latch mechanisms.

Other implementations will be apparent to those skilled in the art from consideration of the specification and practice of the examples disclosed herein.

For example, it is possible to implement a method for actuating a switching rocker arm 300 comprising an optimized latch pin 10 response time for a switching rocker arm 300 engine application which has a low available pressure.

As another example, a system can be built, such as a variable valvetrain, for a switching rocker arm 300 comprising a latched switching rocker arm 300 connected to a hydraulic control circuit, and the latched switching rocker arm 300 comprises a latch cage 30 configured with oil leakage paths so as to form flow areas 260.

As another example, a latch cage 30 can be configured in a switching rocker arm 300 to comprise oil leakage paths such as first and second end flats 41, 42 to form flow areas 260.

As another example, a switching rocker arm 300 can comprise a latch cage 30 configured in a latch port 202 to comprise oil leakage paths between the latch cage 30 and the latch port 202.

What is claimed is:

1. A latch assembly, comprising:
- a latch pin, comprising:
  - a latch nose; and
  - a pin body connected to the latch nose, the pin body comprising an outer surface and an inner compartment, the inner compartment comprising:
    - a first inner wall; and
    - a second inner wall;
- a cage, comprising:
  - a stepped base; and
  - a shaft extending from the stepped base into the inner compartment, the shaft comprising:
    - a first exterior flat adjoining the first inner wall; and
    - a second exterior flat adjoining the second inner wall;
  - wherein the stepped base comprises a first end flat parallel to the first exterior flat and a second end flat parallel to the second exterior flat; and
- a spring biased against the latch pin and the cage.

2. The latch assembly of claim 1, wherein the inner compartment further comprises:
- a first slot segmenting the first inner wall; and
- a second slot segmenting the second inner wall,
- wherein the first slot and the second slot vent out of the inner compartment.

3. The latch assembly of claim 2, wherein the shaft further comprises a first exterior arc surface and a second exterior arc surface.

4. The latch assembly of claim 3, wherein the inner compartment comprises an inner circumference segmented into a first arc, a first chord, a second arc, and a second chord, wherein the first chord is part of the first inner wall, and wherein the second chord is part of the second inner wall.

5. The latch assembly of claim 4, wherein the first arc is opposite to the second arc.

6. The latch assembly of claim 4, wherein:
- the first exterior arc surface adjoins the first arc; and
- the second exterior arc surface adjoins the second arc.

7. The latch assembly of claim 1, wherein the shaft or the stepped base forms a travel limit for the pin body.

8. The latch assembly of claim 1, wherein the stepped base is solid.

9. The latch assembly of claim 1, wherein the shaft comprises a hollow portion.

10. The latch assembly of claim 9, further comprising a solid spring cup between the stepped base and the hollow portion.

11. A latching device comprising the latch assembly of claim 1, the latching device further comprising:
- a housing comprising a latch bore comprising a main inner circumference;
- the latch pin configured to slide in the latch bore with the outer surface adjacent the main inner circumference; and
- the stepped base fitted to a portion of the main inner circumference.

12. The latching device of claim 11, wherein:
- wherein the stepped base spans across the main inner circumference to fit to opposed sides of the main inner circumference, and
- wherein the first end flat and the second end flat are spaced away from the main inner circumference.

13. The latching device of claim 12, wherein:
- the housing further comprises an outer end surface through which the latch bore passes; and
- the stepped base comprises a first step and a second step positioned against the outer end surface.

14. The latching device of claim 11, further comprising an oil feed through the housing and connected to the latch bore.

15. A rocker arm comprising the latching device of claim 11, the rocker arm comprising:
- a pair of outer arms integrated with the housing; and
- an inner arm coupled to the pair of outer arms, the inner arm configured to selectively move relative to the latch pin when the latch pin is retracted into the latch bore and configured to selectively abut the latch nose when the latch pin protrudes from the latch bore.

* * * * *